United States Patent [19]

Beery

[11] 4,353,540

[45] Oct. 12, 1982

[54] SHEET FEEDER WITH PIVOTABLE BAFFLE

[75] Inventor: Jack Beery, Fairport, N.Y.

[73] Assignee: Xerox Corporation, Stamford, Conn.

[21] Appl. No.: 183,690

[22] Filed: Aug. 29, 1980

[51] Int. Cl.[3] ..... B65H 9/06; B65H 9/00

[52] U.S. Cl. ..... 271/10; 271/116; 271/245; 271/264; 271/270

[58] Field of Search ..... 271/245, 246, 247, 242, 271/243, 253, 254, 255, 270, 226, 227, 116, DIG. 9, 10, 19, 21, 264; 226/18, 21, 195, 197; 355/3 SH

[56] References Cited

U.S. PATENT DOCUMENTS

| | | | |
|---|---|---|---|
| 3,893,662 | 7/1975 | Boyd | 271/10 |
| 3,980,295 | 9/1976 | Kleid | 271/242 |
| 3,986,650 | 10/1976 | Swanke et al. | 226/21 |
| 4,009,957 | 3/1977 | Suzuki et al. | 355/3 SH X |
| 4,013,204 | 3/1977 | Hellemans | 226/21 |
| 4,025,187 | 5/1977 | Taylor et al. | 271/245 X |
| 4,085,673 | 4/1978 | Wierszewski | 101/242 |
| 4,216,482 | 8/1980 | Mason | 346/129 |
| 4,266,762 | 5/1981 | Kramer et al. | 355/3 SH |

*Primary Examiner*—Bruce H. Stoner, Jr.

[57] ABSTRACT

A sheet feeding apparatus including a sheet feeder to feed a sheet from a supply in a forward direction, a sheet registration gate for registering a sheet, the sheet feeder and sheet registration gate being separated by a distance less than the feeding dimension of the sheet being fed such that when the sheet feeder is actuated it feeds a sheet forward toward the registration gate and forms a buckle in the sheet. A sheet guide comprising a baffle pivotally mounted to be articulated within the path of the sheet being fed such that when it is contacted by the short edge of the sheet buckle and initiates tension in that edge it articulates reducing the tension on the short edge of the buckle and advances toward contact and the initiation of tension with the long edge of the sheet buckle. By articulation the baffle tends to equalize the tension on both edges of the sheet and thereby minimizes skewed sheet feed.

11 Claims, 11 Drawing Figures

88
92
91
85
83
95
94
87
93
83
91
92
98
97
96

88
93
94
95
83
86
90

92
87
88
87
92

96
98
88
93
95

98
96
93
95

SHEET FEEDER WITH PIVOTABLE BAFFLE

BACKGROUND OF THE INVENTION

This invention relates to sheet feeding apparatus and in particular to apparatus for delivering sheets from a supply of sheets with reduced or minimized skew of the lead edge.

In the reproducing apparatus available today individual sheets of copy paper are separately fed through the copier and processed one at a time. In this process it is convenient to have a supply stack of sheets from which to feed the individual sheets. In addition, modern day business desires require that a copier be capable of faithfully reproducing original documents of various sizes, configurations and on various types of copy sheets. To facilitate this operational flexibility it has been customary to provide the supply of cut sheets in a cassette form. Typically the stationary feeding and registering devices in automatic copying machines are compact with the distance from the cassette sheet supply to the registration point being less than the length of a single copy sheet. This permits a compact design as well as a reduction in the complexity of the machine. Frequently in the interest of conserving additional floor space the paper path from the supply cassette to the registration position is arcuate, often times even being direction reversing such that the initial feed of a copy sheet from the cassette supply is in one direction, while the feed to the operational points of the apparatus is to the opposite direction.

In a typical such device the top sheet of a stack of paper is first separated from the stack and fed forward over the snubbers of a forward feed corner snubber system through a guide path which eventually reverses the direction of travel of the sheet by 180° C. up to the registration position. In this system as the lead edge of the sheet being fed is registered against a registration guide or the nip formed between a pair of pinch rolls the feed rolls continue to advance the sheet forming a buckle in the sheet between the feed rolls and the registration device. Once the buckle is formed the feed roll drive is inactivated while the trailing edge is still contained in the nip between the rolls and the supply stack. When the registration gate is opened the paper initially urges or snaps forward uniformly with the lead edge maintaining registration. The register rolls feed the sheet forward at the apparatus process speed with the feed rolls which are stationary on the supply cassette being slowly rotated and driven to the process speed via paper being pulled from under the rolls through an overrunning clutch. Thus as the paper is being fed forward by the registration rolls the feed rolls turn gradually applying a tension to the paper. This action happens quickly, there is a slack in the sheet being fed followed by a snap as tension is produced. When the buckle between the feed rolls and the registration rolls in the sheet being fed eventually is eliminated it usually occurs by placing either one of the inboard or the outboard edge of the sheet in tension first while the other edge remains flexible with some buckle. This is because the initial feeding from the cassette by the feed rolls fed to the lead edge into registration with the registration gate or rolls but fed the inboard and the outboard edges of the sheet at different rates or displacements due to slippage and feed rate differential. Once registered the lead edge remains registered while being fed forward by the registration rolls until tension is placed on one of the inboard or outboard edges. The side on which the tension first appears is the side which has the smallest buckle or to put it another way, the side which has been fed or displaced forward by the feed rolls the shorter distance. Once the tension is placed on one side of the sheet being fed, it tends to induce a slip between the registration roll and the sheet on that side. At the same time the opposite side of the sheet is being fed forward by the registration rolls at the usual rate since there is no tension on the sheet. This unequal feeding of opposite sides of a sheet results in the introduction of a skew in feed of the sheets. The sheets then may become misaligned resulting in skewed images on the copy sheet or in some exaggerated situations cause paper jams in their path through the copier.

An analysis of the above problem indicates that initially the lead edge of a sheet is registered against the registration rolls while the trailing edge is held between the inactivated feed rolls and the supply stack with a small buckle being formed in the sheet between the two sets of rolls. Generally the size of the buckle is not the same for both the inboard and the outboard side. Therefore when the registration rolls start to feed a stable condition exists and both the inboard and the outboard edge of the sheet are fed at the same rate. As the buckle on one side is reduced it reaches a point where tension exists on one side between the feed roll and the registration roll giving rise to an unstable feeding condition which causes skewing of the sheet being fed. Once a skew is installed in the sheet being fed past the registration system it is beyond the normal design capabilities of the device to remove the skew from the sheet. When the buckle on the non-initial tension side is removed both the inboard and the outboard edges of the sheet are in tension and once again a stable condition exists. In addition when the trailing edge of the sheet being fed leaves the feed rolls, a stable condition also exists. However in both instances while stability has been restored to the feeding of sheets, a skew has already been installed in the system which has not been removed and which can lead to the problems discussed above.

Furthermore there is an increased propensity for the sheets being fed to skew with different size papers or from different feed stations. Thus while a sheet feeding system may be fine tuned for sheets of one size or type or feed station it will not be in a fine tuned condition for sheets of another size or character.

SUMMARY OF THE INVENTION

In accordance with this invention a sheet feeding apparatus with an improved potential sheet feed skew detector and modifier is provided. This sheet feeding apparatus contains an articulated pivotally mounted baffle which automatically mechanically detects the potential for skewed sheet feeding and adjusts its orientation to balance tension on the two sides of the sheet being fed.

More particularly, the present invention is directed to a sheet feeding apparatus comprising a forward feed means to feed a sheet from a sheet supply in a forward direction, a sheet registration means for registering a sheet being fed with the distance from the forward feed means to the registration means being less than the feeding dimension of the sheet being fed, a means to actuate the forward feed means to feed a sheet in a forward direction while forming a buckle in the sheet between the forward feed means and the sheet registration means and a baffle mounted between the forward feed means and the registration means being pivotally mounted to be articulated within the path of the sheet being fed such that when it is contacted by the short or first displacement edge of the sheet buckle and initiates tension in that edge of the sheet, the baffle articulates so that it advances toward contact and the initiation of tension with the long or second displacement edge of the sheet buckle.

The present invention provides an articulating baffle which pivots when first contacted by the short or first displacement edge of a sheet in tension to simultaneously reduce the tension on that edge and increase the tension on the opposite edge to balance the tension on both sides.

Accordingly it is an object of the present invention to provide a novel sheet feeding apparatus.

It is a further object of the present invention to provide an apparatus to inhibit the formation of sheet skew in a sheet feeding apparatus.

It is an additional object of the present invention to provide a sheet feeding apparatus capable of feeding sheets of various sizes with a minimum of skew.

It is an additional object of the present invention to provide an anti skewing device for a sheet feeder which automatically mechanically detects the potential for skewed sheet feeding and adjusts its orientation to minimize same.

For a better understanding of the invention as well as other objects and further features thereof reference is had to the following drawings and description.

DESCRIPTION OF PREFERRED EMBODIMENT

The invention will now be described by reference to a preferred embodiment of the sheet feeding apparatus.

Figure 1:
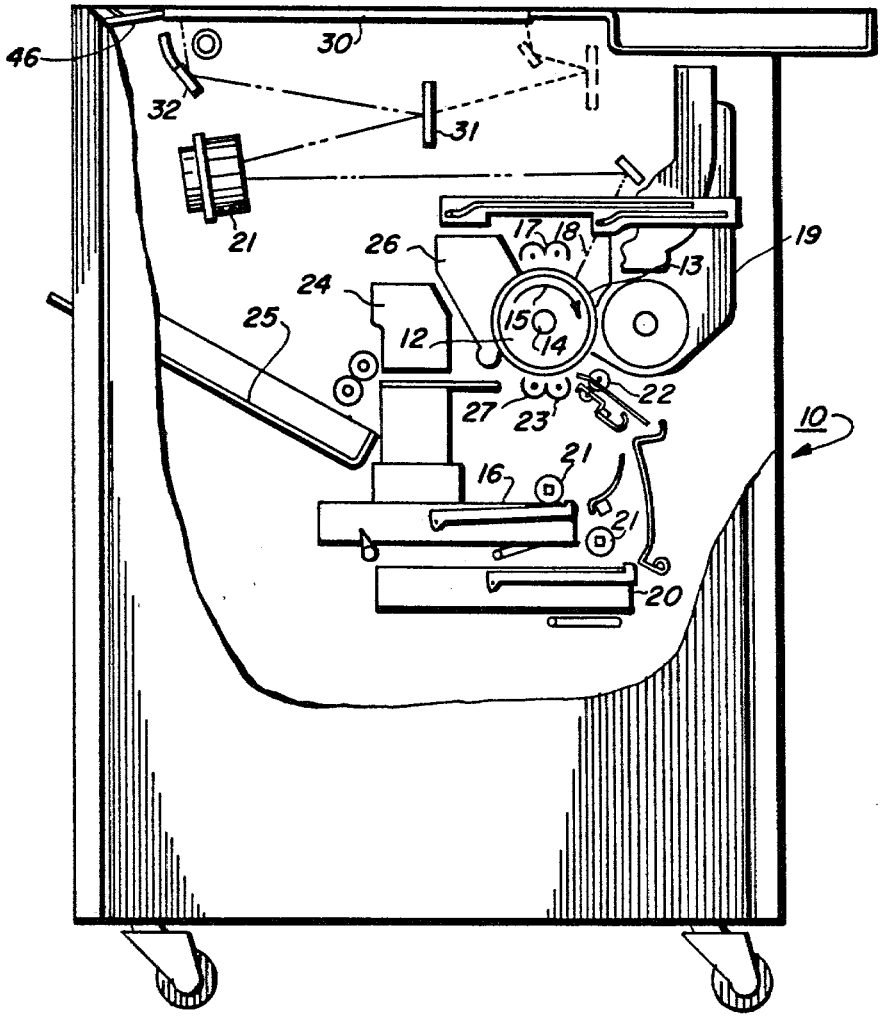
FIG. 1 is a schematic representation in cross section of an automatic xerographic reproducing machine with the sheet feeding apparatus of the present invention.

Referring now to FIG. 1 there is shown by way of example an automatic xerographic reproducing machine 10 which includes the sheet feeding apparatus of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator feed roll 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformily charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a cleaning blade.

Normally, when the copier is operated in a conventional mode, the original document to be reproduced is placed image side down upon a horizontal transparent viewing platen 30 and the stationary original then scanned by means of a moving optical system. The scanning system fundamentally consists of a stationary lens system 21 positioned below the right hand margin of the platen as viewed in FIG. 1 and a pair of cooperating movable scanning mirrors 31, 32 which are carried upon carriages not illustrated.

It is believed that the foregoing general description is sufficient for purposes of the present application to illustrate the general operation of an automatic xerographic copier 10 which can embody the apparatus in accordance with the present invention.

Figure 2:
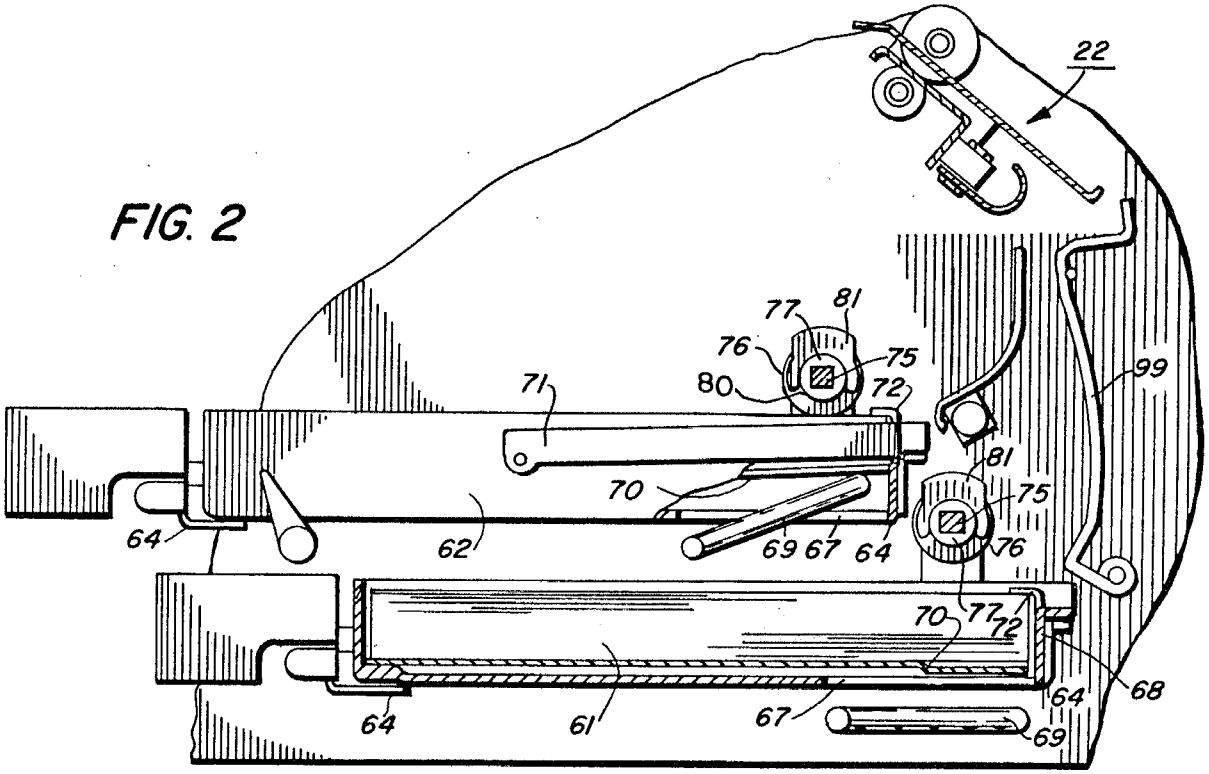
FIG. 2 is an enlarged schematic representation in cross section of the sheet feeding apparatus of the present invention.
Figures 3, 4:
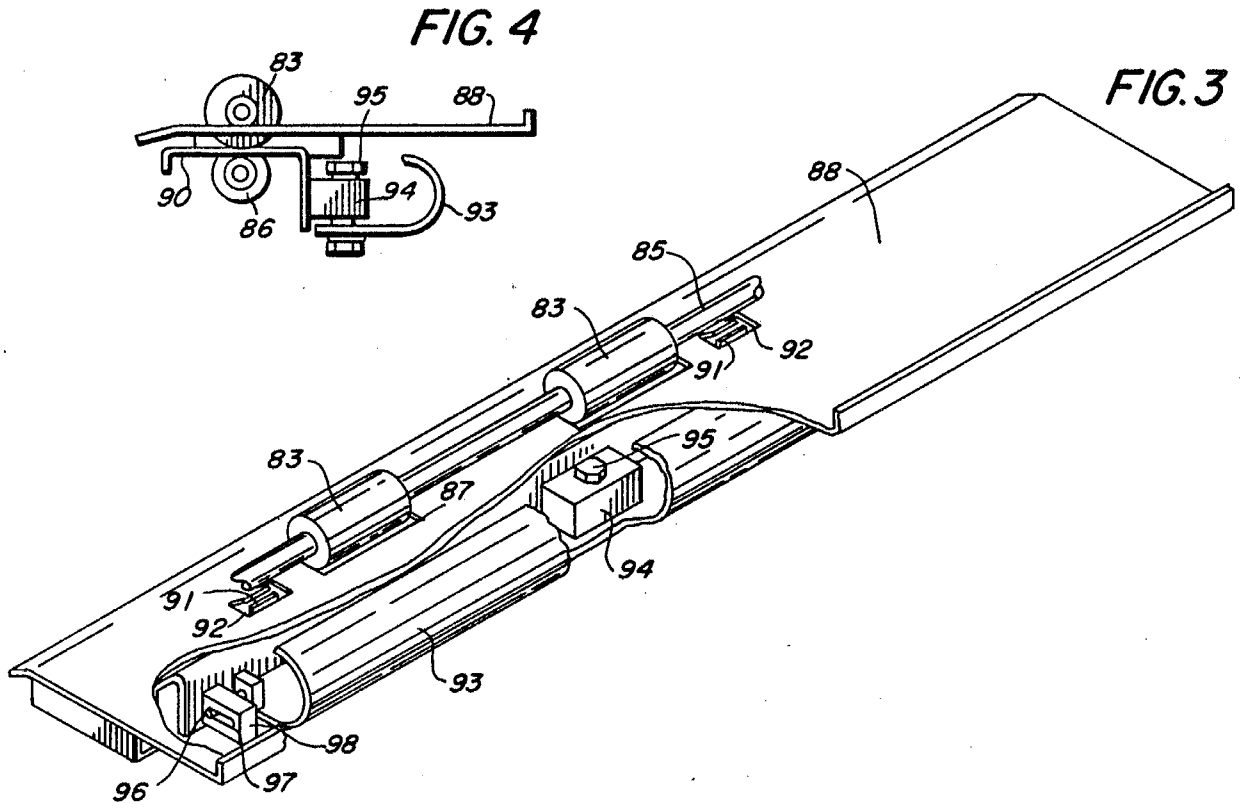
FIG. 3 is an isometric view of the articulated baffle and registration apparatus of the present invention.
FIG. 4 is a side view of the articulated baffle and registration apparatus of the present invention.

Referring more particularly to FIG. 2 wherein the sheet feeding apparatus is shown in greater detail. In FIG. 2 the sheet feeding apparatus is illustrated with two cassette sheet supplies each with its own roll separator feeder. It should be noted, however, that the sheet feeder of the present invention is also applicable to systems wherein only a single cassette and feeder is provided. The cassettes 61 and 62 are slidingly mountable on a pair of guide rails 64 as they are inserted into the sheet supply cavity from the front of the copying machine.

The cassettes 61 and 62 comprise a generally box like configuration with a sheet holding cavity in the center surrounded by thin walls. The floor of the cassette has an aperture 67 through which a lifting tongue 69 lifts a tray 70 bringing the sheet supply into feeding engagement with the feed rolls 76. The tray 70 is pivoted about its sheet feeding trailing edge so that the sheet supply is raised up above the height of the wall 68 at the front of the cassette. Pivotally mounted on the side walls of the cassette are two arms 71 with corner snubbers 72 on the other end of the arms. The snubbers are arranged to ride on the corners of a stack of sheets inhibiting the forward motion of the corners of the sheets when a sheet is fed in the forward direction.

The feed roll shafts 75 which are suitably journaled in front and rear frame members (not shown), are generally square in cross section. The fixed feed roll 76 comprises a hub 77 mounted on shaft 75, the hub having a round circumference with the feed roll 76 mounted on the hub. An overrunning spring clutch 80 is mounted between the hub and the feed roll and the whole assembly is held in place with snap ring 81. The feed roll 76 is fixedly mounted in the axial direction a short distance in from the side of the paper supply.

Turning now to FIGS. 3–8 the sheet feeding apparatus may be seen in greater detail. The registration system includes a pair of registration rolls 83 fixedly mounted to rotating shaft which is driven through means not shown. Each of the registration rolls are in slight pressure contact with backing idler rolls 86 through apertures 87 in the top registration guide plate 88 which together with the bottom registration guide plate 90 forms a guiding path for a sheet being fed from the supply stack to the processing station. The sheet being fed is registered against registration gate tabs 91 which protrude through apertures 92 in the top registration guide plate 88. The registration gate tabs are mechanically withdrawn by means not shown after the lead edge of a sheet has been registered against them and it is desired to forward the sheet to the various process stations. While the registration device has been described and illustrated with reference to a system using a retractable registration gate, it should be understood that other registration systems perform equally well. For example, the nip between the registration rolls and the idler rolls may also function effectively as a registration gate in a stalled roll system.

The articulating registration baffle 93 is pivotally mounted to pivot support 94 on bottom registration guide plate 90 through bolt 95 and is capable of pivoting about bolt 95 in a small arc which is restricted by a pin 96 fixed to one end of the baffle 93 in containment slot 97 of slot support 98 which is fixed to the bottom registration guide plate 90. The registration baffle 93 is arcuate or curved to provide a gradual rather than an abrupt sheet guide thereby maintaining continuity of sheet feeding.

Figure 5B:
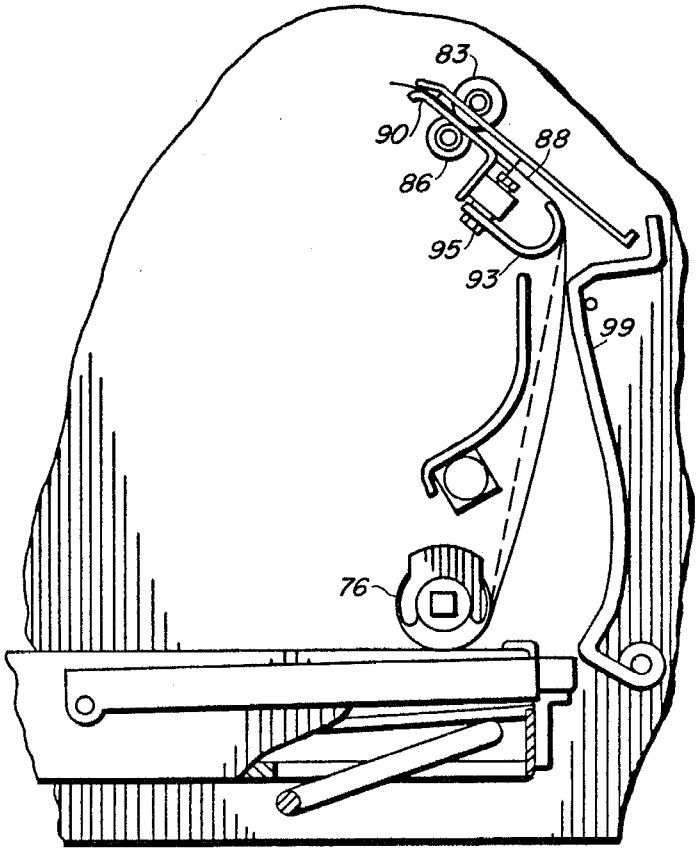
FIGS. 5*a*, 5*b*, 5*c* and 5*d* are side views of the sheet feeding apparatus depecting the articulated baffle and sheet being fed in both stable and unstable conditions.
Figure 5A:
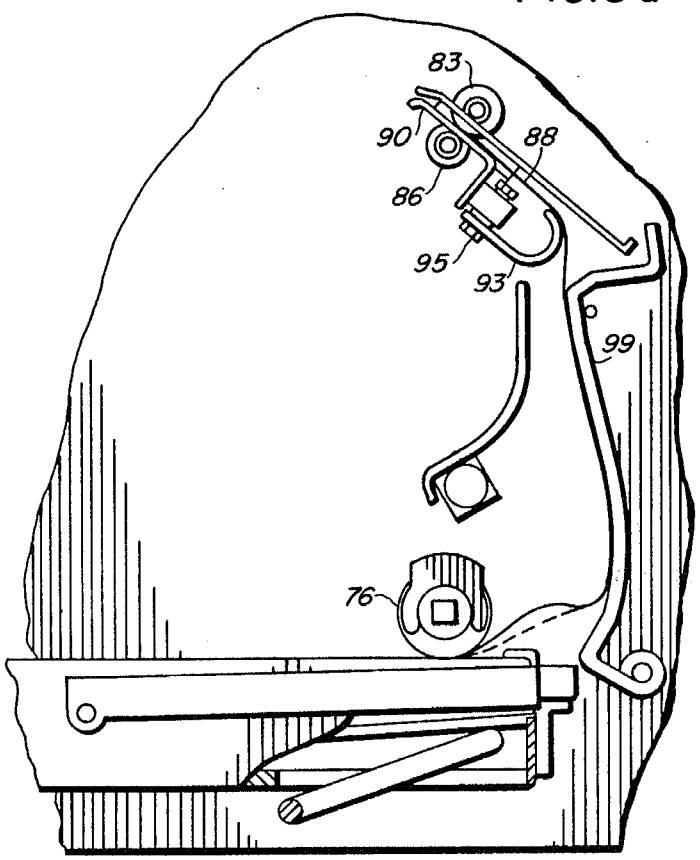
Figure 5D:
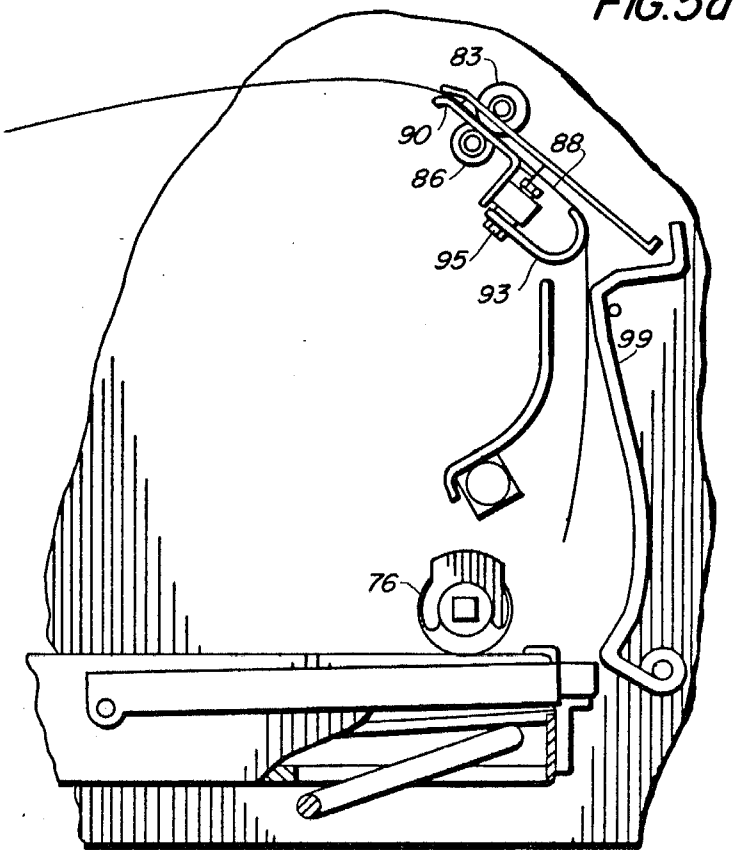
Figure 5C:
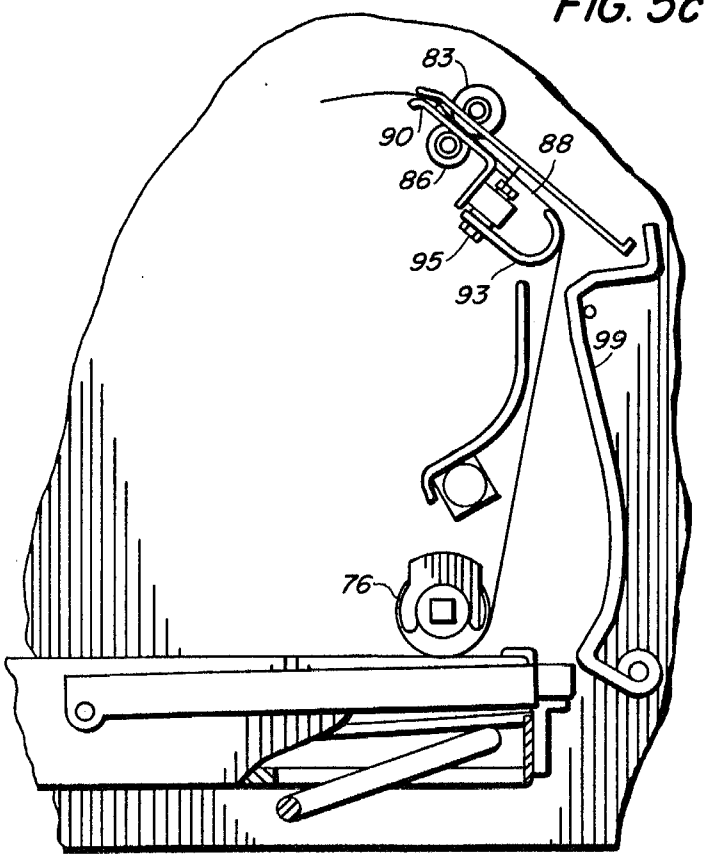
Figure 6:
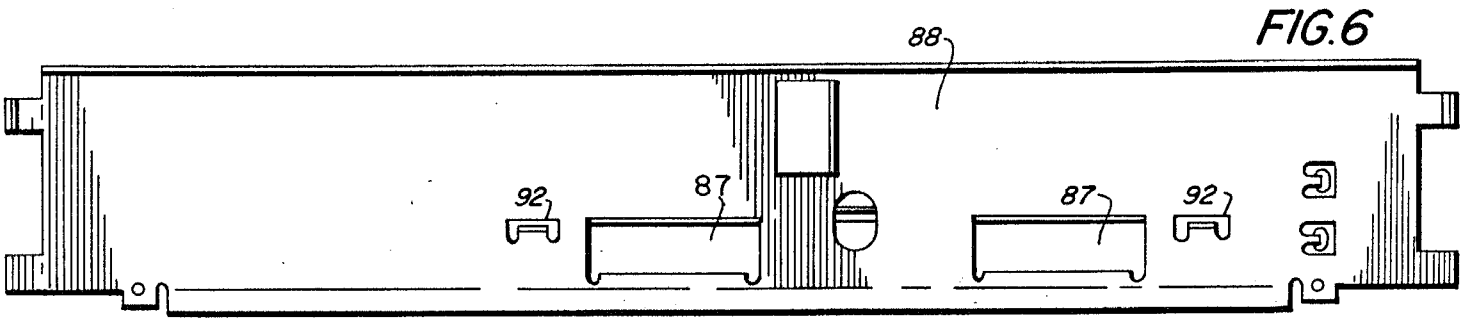
FIG. 6 is a top view of the registration mounting with attached the articulated baffle of the present invention.
Figure 7:
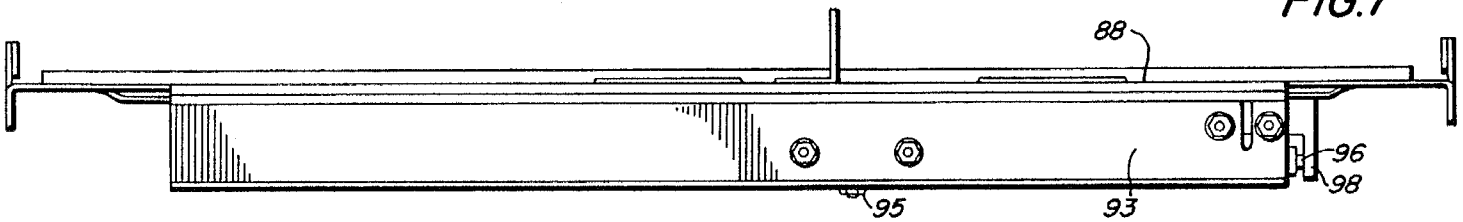
FIG. 7 is a end view of the registration mounting the attached the articulated baffle of the present invention.
Figure 8:
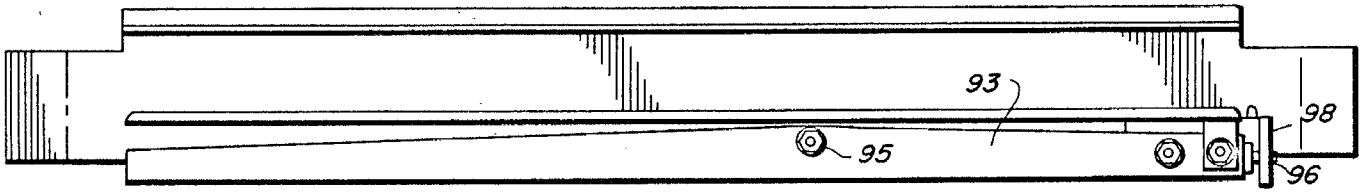
FIG. 8 is a bottom view of the registration mounting with attached the articulated baffle of the present invention.

With particular reference to FIGS. 5*a*, 5*b*, 5*c* and 5*d*, the operation of the present invention may be more clearly illustrated. In FIG. 5*a* a sheet has been separated from the stack of sheets and fed forward by feed roll 76 against sheet guide 99 to the registration gate and rolls. In this condition the leading edge is registered against the registration gate and since the feed rolls advance the sheet after the leading edge is registered there is a buckle in the sheet between the feed rolls and the registration rolls. However the buckle may not be uniform on both sides and as illustrated, the inboard edge or side of the sheet, illustrated in solid lines, has more buckle than the outboard edge or side, illustrated in dashed line. FIG. 5*b* illustrates the situation as the registration rolls start to drive the sheet forward. Since the trailing edge of the sheet is held between the idle feed roll and the next sheet in the supply stack it tends to straighten the buckle that was illustrated in FIG. 5*a*. In FIG. 5*b* the buckle has been straightened out on the outboard side of the sheet with the sheet just coming into contact with the articulating baffle. In this condition the leading edge of the sheet remains in registration perpendicular to the process direction and the trailing edge remains held between the feed roll and the supply stack, the buckle has been eliminated on the outboard side but a small buckle remains on the inboard side. With additional advancement of the sheet tension will first be experienced by the outboard side of the sheet as a result of the registration rolls trying to feed forward the leading edge while the trailing edge of the now taut outboard edge is held in place in the nip between the feed roll and the supply stack. As this tension is experienced unless some action is taken the outboard side of the sheet will tend to slip in the registration roll nip. Simultaneously the registration roll will continue to feed the inboard side forward producing a skew in the leading edge of the sheet. According to the present invention as the outboard side begins to come into tension it presses up against the baffle which due to the tension in the sheet is articulated to move the outboard edge of the baffle away from the outboard edge of the sheet thus minimizing the tension on the outboard side of the sheet and moving the inboard edge of the baffle toward the inboard edge of sheet thus tending to increase tension on the inboard edge of the sheet. In this way the articulating baffle tends to equalize or stabilize the tension on both sides and with the same tension there is a uniform drag across the trailing edge and the sheet continues to be fed forward with the leading edge perpendicular to the process direction. FIG. 5*c* illustrates this stable condition after the outboard edge of the baffle has been pushed by the tension in the sheet to the rear and the inboard edge of the baffle has been urged forward to place tension in the sheet. As can be seen from FIG. 5*c*, there is no buckle in either side of the sheet, both sides are in tension, and a stable condition exists. Similarly, FIG. 5*d* illustrates the additional stable condition when the trailing edge of the sheet being fed is released from the nip between feed roll and the supply stack of sheets.

While the above description relates to the outboard side of the sheet being fed coming into tension first since the baffle is not balanced in that the pivot point is closest the outboard side, it must be understood that the instance where the baffle is balanced it is equally likely that the inboard side of the sheet being fed will come into tension first and that the articulating baffle will push in the opposite way. Either the inboard or the outboard edge of the sheet being fed may come under tension first creating the unstable condition as a result of the registration rolls trying to drive the leading edge of the sheet forward while the feed rolls try to maintain the trailing edge in place. In this condition the side of the sheet being fed under tension would tend to slip with the opposite side moving forward at a predictable velocity. However as described above the articulating baffle pivots within the path of the sheet being fed such that when it is contacted by the short or first displacement edge of the sheet buckle placing that edge of the sheet in tension, it pivots and simultaneously reduces the tension on that edge of the sheet buckle while advancing toward contact with the long or second displacement edge of the sheet buckle. Eventually both sides of the sheet buckle end up in tension and the stable sheet feeding condition has been reestablished. If the baffle is very light having low inertia and the friction at the pivot point is also very low, the ease in going from the initial stable condition to the final stable condition without having an unstable feeding condition is even further enhanced.

In accordance with the invention a sheet feeding apparatus with an articulating sheet baffle arrangement to provide stable sheet feeding is provided. While the invention has been described with reference to the specific embodiments described it will be apparent to those skilled in the art that many alternatives, modifications or variations may be made. For example, while the invention has been described with reference to a system where the forward feed rolls restrain the trailing edge of the paper being fed, it has equal application to a system with any means for producing tension in both edges of the sheet being fed. Accordingly it is intended to embrace all such alternatives and modifications as may fall within the spirit and scope of the appended claims.

I claim:

1. A sheet feeding apparatus comprising a forward feed means to feed a sheet from a sheet supply in a forward direction;

a sheet registration means for registering a sheet being fed, the distance from the forward feed means to the registration means being less than the feeding dimension of the sheet being fed;

means to activate the forward feed means to feed said sheet in a forward direction toward said registration means and to form a buckle in said sheet between said forward feed means and said sheet registration means, sheet guide means mounted between said forward feed means and said registration means, said guide means comprising a baffle pivotally mounted to be articulated within the path of the sheet being fed such that when it is contacted by the short side edge of the sheet buckle and initiates the placement of tension on that edge of the sheet it articulates simultaneously reducing the tension on that edge of the sheet buckle and advancing toward contact and the initiation of tension with the other side edge of the sheet buckle to thereby tend to equalize tension on both edges of the sheet.

2. The sheet feeding apparatus of claim 1 wherein said forward feed means comprises means for producing tension in both edges of a sheet being fed.

3. The sheet feeding apparatus of claim 2 wherein said forward feed means comprises laterally spaced feed means and said registration means comprises laterally spaced registration nips.

4. The sheet feeding apparatus of claim 3 wherein said articulating baffle is mounted on a pivot between said laterally spaced forward feed means and said registration means thereby enabling said baffle to pivot when first contacted by a first edge of a sheet in tension to simultaneously reduce the tension on that edge and increase the tension on the opposite edge.

5. The sheet feeding apparatus of claim 4 wherein said forward feed means comprises a pair of feed rolls mounted to feed a sheet from a supply of sheets.

6. The sheet feeding apparatus of claim 5 wherein said sheet registration means comprises the nip between a pair of driven register rolls and a backed idler roll.

7. The sheet feeding apparatus of claim 6 wherein said sheet registration means further comprises a registration gate and means to insert and withdraw said gate from the sheet path defined by the path between the register rolls and the idler rolls.

8. The sheet feeding apparatus of claim 5 wherein each of said pair of feed rolls is mounted on an overrunning clutch.

9. The sheet feeding apparatus of claim 1 wherein the sheet feed path is an arcuate direction reversing path from said sheet supply and forward feed means to said sheet registration means and said sheet guide means is positioned in said path.

10. The sheet feeding apparatus of claim 3 wherein said baffle articulates about its pivot whereby the side in tension may be moved in a direction to relax the tension and the non tension side in a direction to place it into tension.

11. The sheet feeding apparatus of claim 10 wherein said baffle has an arcuate functional surface.

* * * * *